US010533299B2

(12) United States Patent
Zamorano Jones et al.

(10) Patent No.: US 10,533,299 B2
(45) Date of Patent: Jan. 14, 2020

(54) PIVOT SYSTEM WITH ADJUSTABLE HEIGHT TO ACTUATE A DOOR LATCH FOR AN EXCAVATOR BUCKET

(71) Applicant: Minetec S.A., Santiago, Región Metropolitana (CL)

(72) Inventors: Claudio Zamorano Jones, Santiago (CL); Bernardo Vera Torres, Santiago (CL); Jean Pierre Vidal Piesset, Santiago (CL)

(73) Assignee: Minetec S.A., Santiago, Región Metropolitana (CL)

( * ) Notice: Subject to any disclaimer, the term of this patent is extended or adjusted under 35 U.S.C. 154(b) by 141 days.

(21) Appl. No.: 15/496,445

(22) Filed: Apr. 25, 2017

(65) Prior Publication Data

US 2017/0306585 A1 Oct. 26, 2017

(30) Foreign Application Priority Data

Apr. 25, 2016 (CL) ..... 0983-2016

(51) Int. Cl.

| | |
|---|---|
| ***E02F 3/407*** | (2006.01) |
| ***E02F 3/40*** | (2006.01) |
| ***E05B 65/00*** | (2006.01) |

(52) U.S. Cl.
CPC ..... *E02F 3/4075* (2013.01); *E02F 3/401* (2013.01); *E05B 65/00* (2013.01)

(58) Field of Classification Search
CPC ..... E02F 3/401; E02F 3/407; E02F 3/4075; E05B 65/00
See application file for complete search history.

(56) References Cited

U.S. PATENT DOCUMENTS

| | | | | |
|---|---|---|---|---|
| 1,607,000 A * | 11/1926 | Hudner | E02F 3/4075 | 37/444 |
| 2,236,391 A * | 3/1941 | Zabel | D06F 37/10 | 292/173 |
| 2,804,356 A * | 8/1957 | Jiroch | B61F 5/14 | 105/199.3 |
| 7,731,197 B2 * | 6/2010 | Stutz | F41J 7/04 | 273/392 |
| 2007/0107269 A1 * | 5/2007 | Hren | E02F 3/4075 | 37/398 |
| 2010/0212194 A1 * | 8/2010 | Hren | E02F 3/4075 | 37/445 |

* cited by examiner

*Primary Examiner* — Jessica H Lutz
(74) *Attorney, Agent, or Firm* — Hoffman Warnick LLC

(57) ABSTRACT

Earth movement machine components including a pivot system with adjustable height to actuate a door latch for an excavator bucket.

6 Claims, 5 Drawing Sheets

PIVOT SYSTEM WITH ADJUSTABLE HEIGHT TO ACTUATE A DOOR LATCH FOR AN EXCAVATOR BUCKET

CROSS-REFERENCE TO RELATED APPLICATIONS

This application claims the benefit of co-pending Chilean Patent Application No. CL 0983-2016, filed 25 Apr. 2016, which is hereby incorporated herein as though fully set forth.

TECHNICAL FIELD

Embodiments of the invention relate to the field of earth movement machine components and refer specifically to a pivot system with adjustable height to actuate a door latch for an excavator bucket.

DESCRIPTION OF THE PRIOR ART

The latch for excavator machine shovel buckets meets the function of locking the door of the shovel bucket prior to beginning loading in order to prevent the cargo from falling out once material has entered the bucket and keeps it secure during transport done by the excavator to the unloading place. At the moment of unloading, the door unlocks to allow the material to be released in the unloading place, by activating the latch. It can therefore be deduced from the above that this element locks and unlocks many times during the work of loading and unloading an excavator's bucket.

Activation of the latch is made by a mechanical system. This system consists of a lever mechanism comprising an arm which is supported in an articulated manner on the bucket's structure by one end and the other end is attached to a cable by which the arm is raised when activated by the operator. The mechanism lifts the latch which is also attached in an articulated manner to an area near the articulated end of the arm, exerting a lever multiplier effect with respect to the force applied by the mechanism activated by the operator on the cable, which lifts the latch and allow the door to unlock to release the material. The arm end in its articulated portion is mounted on a box support, which is in turn mounted on a set of shims that allow the adjustment of said arm's height, since repeated use causes wear on the latch tip. This prevents the latch from being trapped in the eye of the latch, which would cause the latch lifting mechanism to erroneously or inadequately lock the door.

In the prior art, the set of shims is secured to the bucket structure by using a rod which secures the entire set of shims to said structure, as shown in FIG. 2*a*. The area in which the arm end that lifts or lowers the latch that secures the door to the bucket body and where the shims are pivots is usually called pivot box (1), the shims are located on the front of the pivot box (1) causing said shims (5) to bend by their own weight the fastening rod (7) in the area of its mounting hole (6) when the door (2) is parallel to the ground surface (P), as shown in FIG. 2*b*, particularly during transport of cargo when shims exert, as indicated in the arrows in FIGS. 2*a* and 2*b*, a bending stress on the rod due to gravity in the direction of said arrows. Furthermore, it is difficult to remove the rod and difficulties are generated in height adjustment in the pivot box, and shims can possibly fall, disabling the operation of the latch mechanism.

The proposed use model changes the position and the manner to secure the shims inside the pivot box, avoiding the above problems.

SUMMARY OF THE INVENTION

A pivot system with an arm's adjustable height to actuate a door's latch for an excavator bucket which compensates for wear on the latch, where the location of shims is changed to the side of the pivot box and an upper trap is implemented which is welded to the door structure, providing an increased rigidity to a rod for fastening shims and preventing its movement due to a securing mechanism, preventing shims from falling out, the shims with this new distribution are supported by the beams at their sides, becoming trapped and not exerting any force on the rod. The rod can optionally be secured by a cotter pin or using a bolted lock.

DETAILED DESCRIPTION OF THE INVENTION

Figure 1:
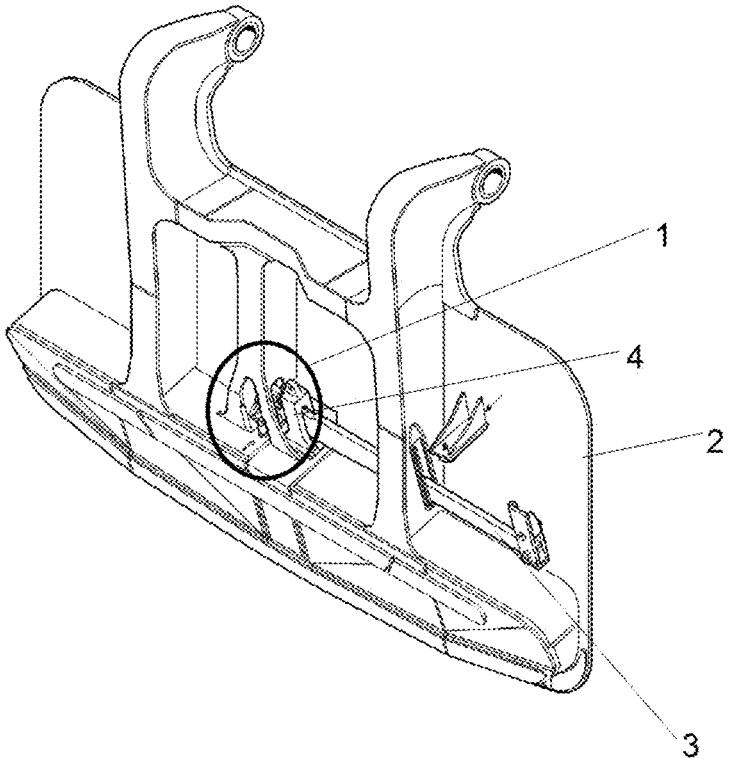
Prior Art Figure 1
FIG. 1 shows an isometric view of the location of the pivot box on a door and the latch lifting elements.

During actuation for unlocking the door (2) of the backhoe bucket, an arm (3) is lifted and lowered from its end (13) by a cable controlled by a mechanism activated by the operator, the arm (3) is attached in an articulated manner by its other end through a mounting hole (12) to the axis (10) of a box support (9) located inside a pivot box (1). A set of shims (5) is located in the base (11) of the box support (9), said shims are secured to the structure (14) of the door (2) by a rod (7) passing through mounting holes (6) of the shims (5) and subsequently fastening slidably to the structure (14) of the door (2) through a hole (18) for such purpose.

Figure 2A:
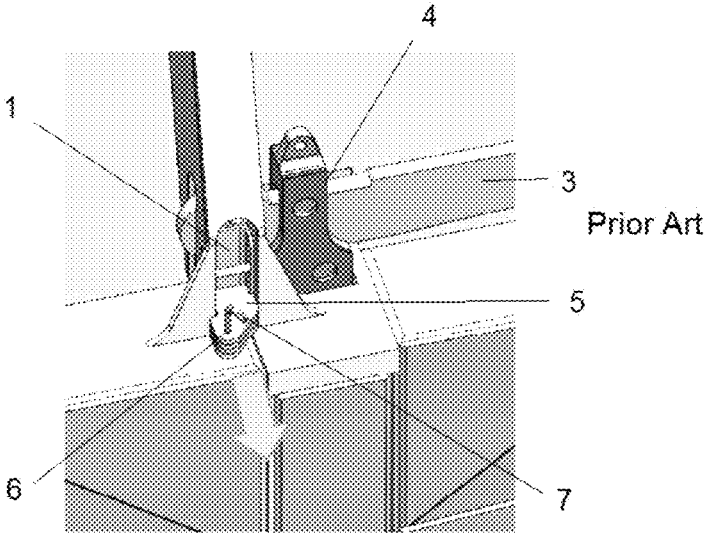
FIG. 2*a* shows an isometric view of the latch and the pivot box with the location of the shims and the rod according to the state of the art.
Figure 2B:
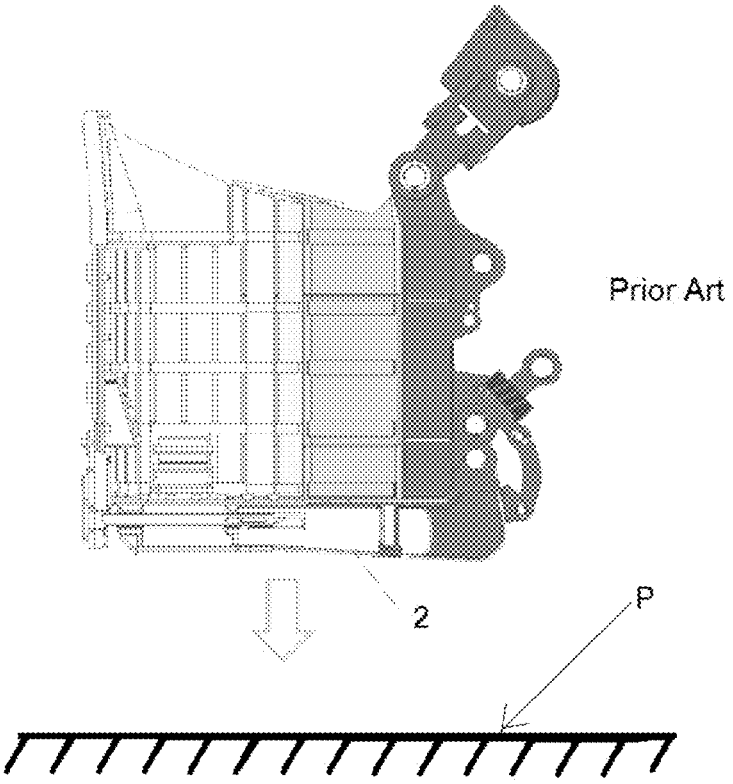
FIG. 2*b* shows the bucket when the door is parallel to the ground surface during transport of the cargo.
Figure 3:
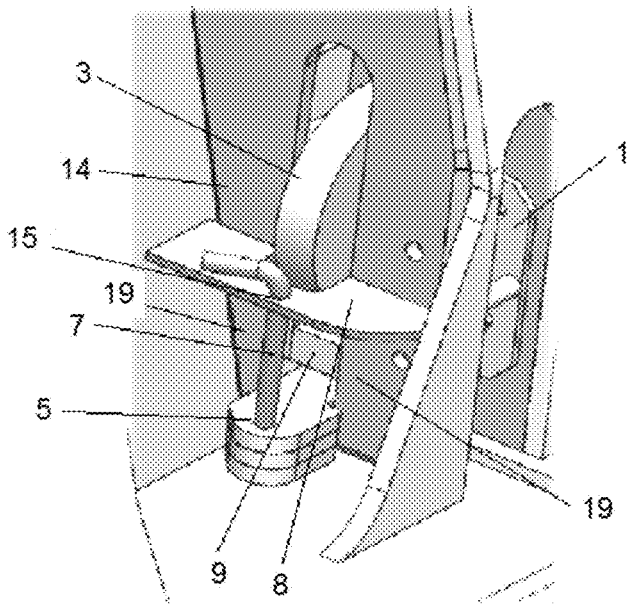
FIG. 3 shows an isometric view of the changes made in the position and the manner for securing the shims.
Figure 4:
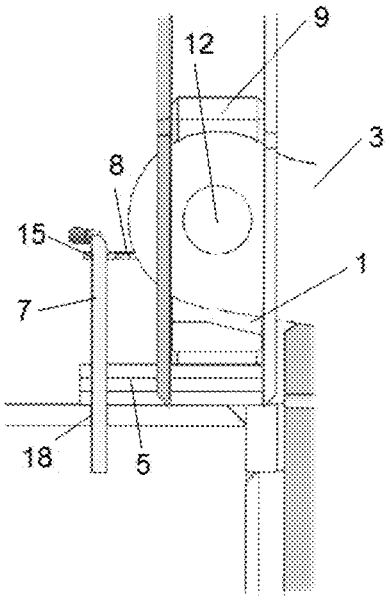
FIG. 4 shows a side view of the changes made in the position and the manner for securing the shims.
Figure 5:
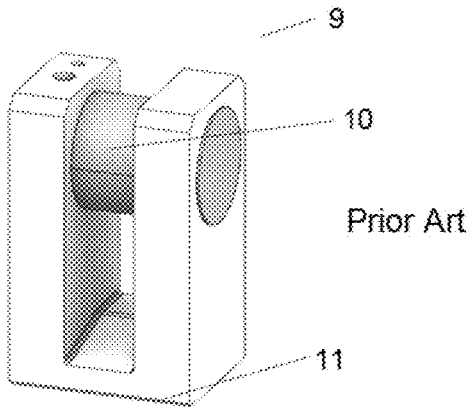
FIG. 5 shows a pivot box support.
Figure 6:
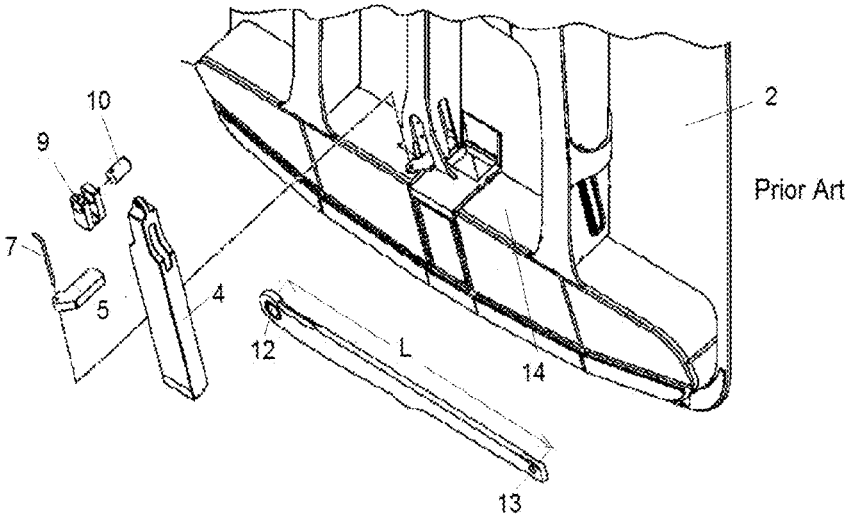
FIG. 6 shows an exploded view with the main component parts of the latch actuation system and contained in the pivot box.
Figure 7B:
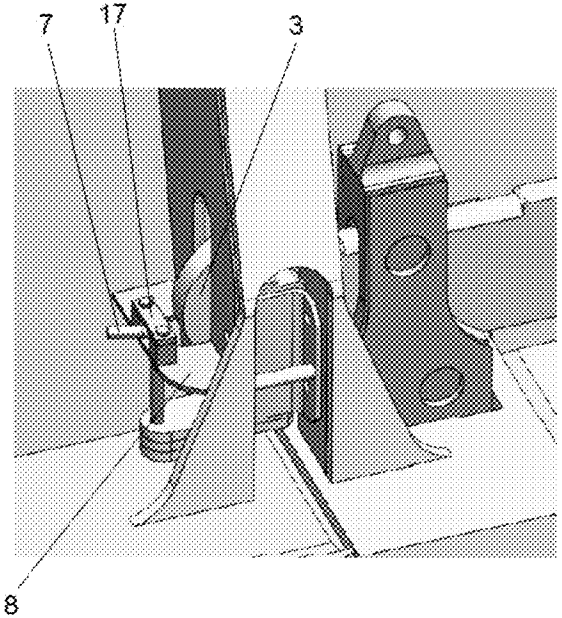
FIG. 7*b* shows the fastening of the shims' securing rod using a bolted lock.
Figure 7A:
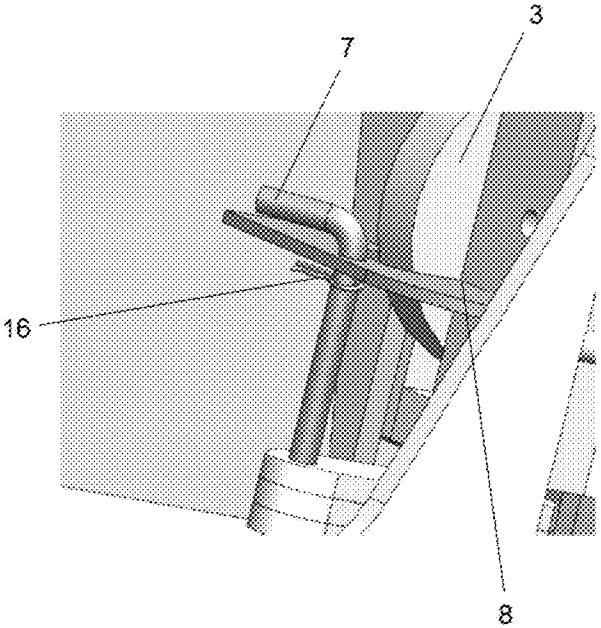
FIG. 7*a* shows the fastening of the shims' securing rod using a cotter pin lock.

The proposed solution is displayed in FIGS. 3 and 4 wherein an upper trap (8) is implemented which is welded to two beams (19) forming a part of the structure of the door (14) providing an increased rigidity to the rod (7) and preventing its movement by preventing shims (5) from falling out. Furthermore, the location of the shims (5) is changed to the side of the pivot box (1), said shims (5) becoming parallel to the arm's length (L) and not perpendicular to said length (L) as described above for the state of the art, where it is transverse to the direction of gravity as shown by the arrows in FIGS. 2*a* and 2*b*, this causes the weight of the shims (5) not to affect or bend the rod (7). Furthermore, the shims (5) with this new distribution are supported by beams (19) on their sides, becoming trapped and not exerting any force on the rod (7). As shown in FIG. 7*a*, the rod can be optionally secured by a cotter pin lock (18) or, as shown in FIG. 7*b*, by a bolted lock (17).

In some embodiments, the invention provides a pivot system comprising: an elongate arm having a first end and a second end; a pivot box having an opening through which the first end of the elongate arm extends; a plurality of elongate shims stacked beneath the elongate arm, such that a longitudinal axis of each of the plurality of shims is parallel to an elongate axis of the elongate arm; and a rod extending through each of the plurality of elongate shims.

The invention may further include a trap member oriented above each of the plurality of shims and substantially perpendicular to the longitudinal axis of each of the plurality of shims, wherein the rod extends through the trap member and each of the plurality of elongate shims. A cotter pin may extend through the rod at a location along a length of the rod between the plurality of shims and the trap member or a lock member may be affixed to an upper surface of the trap member, such that at least a portion of the rod is secured between the lock member and the upper surface of the trap member, thereby securing the rod in place. The trap member may be affixed to each of a pair of beams disposed on either side of the elongate arm and at least one of the pair of beams may extend through a portion of each of the plurality of shims, preventing movement of each of the plurality of shims.

What is claimed is:

1. A pivot system comprising:

an elongate arm having a first end and a second end;

a pivot box having an opening through which the first end of the elongate arm extends;

a plurality of elongate shims stacked beneath the elongate arm, such that a longitudinal axis of each of the plurality of shims is parallel to an elongate axis of the elongate arm; and a rod extending through each of the plurality of elongate shims.

2. The pivot system of claim 1, further comprising:

a trap member oriented above each of the plurality of shims and substantially perpendicular to the longitudinal axis of each of the plurality of shims, wherein the rod extends through the trap member and each of the plurality of elongate shims.

3. The pivot system of claim 2, further comprising:

a cotter pin extending through the rod at a location along a length of the rod between the plurality of shims and the trap member, thereby securing the rod in place.

4. The pivot system of claim 2, further comprising:

a lock member affixed to an upper surface of the trap member, such that at least a portion of the rod is secured between the lock member and an upper surface of the trap member, thereby securing the rod in place.

5. The pivot system of claim 2, wherein the trap member is affixed to each of a pair of beams disposed on either side of the elongate arm.

6. The pivot system of claim 5, wherein at least one of the pair of beams extends through a portion of each of the plurality of shims, preventing movement of each of the plurality of shims.

* * * * *